US006371206B1

(12) United States Patent
Mills

(10) Patent No.: US 6,371,206 B1
(45) Date of Patent: Apr. 16, 2002

(54) PREVENTION OF SAND PLUGGING OF OIL WELL PUMPS

(75) Inventor: Ray J. Mills, Calgary (CA)

(73) Assignee: Kudu Industries Inc, Calgary (CA)

( * ) Notice: Subject to any disclaimer, the term of this patent is extended or adjusted under 35 U.S.C. 154(b) by 0 days.

(21) Appl. No.: 09/553,045

(22) Filed: Apr. 20, 2000

(51) Int. Cl.[7] ..... E21B 37/00; E21B 43/00

(52) U.S. Cl. ..... 166/311; 166/64; 166/66; 166/72; 166/105; 166/313; 166/369; 166/373

(58) Field of Search ..... 166/64, 66, 68, 166/72, 105, 105.1, 311, 313, 325, 328, 369, 373

(56) References Cited

U.S. PATENT DOCUMENTS 3,654,995 A * 4/1972 Sizer ..... 166/313
3,963,073 A * 6/1976 Laval, Jr. ..... 166/105.1
4,449,582 A * 5/1984 Peterson et al. ..... 166/64
4,553,590 A * 11/1985 Phillips ..... 166/68 X
4,621,693 A * 11/1986 Caldwell et al. ..... 166/311
5,095,976 A * 3/1992 Appleton ..... 166/105.1
5,494,109 A * 2/1996 Schmitt ..... 166/105 X
5,505,258 A 4/1996 Muth ..... 166/72
5,765,639 A 6/1998 Muth ..... 166/72
5,934,372 A * 8/1999 Muth ..... 166/72
6,125,930 A * 10/2000 Moyes ..... 166/66
6,145,590 A * 11/2000 Havard ..... 166/105.1 X

* cited by examiner

*Primary Examiner*—George Suchfield
(74) *Attorney, Agent, or Firm*—Pearne & Gordon LLP

(57) ABSTRACT

A method and apparatus for unblocking particulate plugs that develop in a well that produces fluid laden with suspended particles when a pump in the well is idled are described. In order to remove the plugs, a valve is inserted in the production tubing above the pump, the valve permitting the well fluid to flow up past the valve but inhibiting the well fluid from flowing down past the valve so that a majority of particles that settle from the well fluid when the pump is idle are trapped above the valve and do not plug the pump. A volume of well fluid trapped between the bottom of the valve and the top of the pump permits pressure waves induced by starting and stopping the pump to be generated. The pressure waves force fluids past the valve until the particles in the plug are resuspended to permit production to resume. The advantage is a simple, low cost solution to a long standing problem which required pulling of the production tubing from the well in order to remove the particulate plug.

17 Claims, 3 Drawing Sheets

PREVENTION OF SAND PLUGGING OF OIL WELL PUMPS

TECHNICAL FIELD

The present invention relates to pumping systems for producing well fluids from petroleum producing formations penetrated by a well and, in particular, to a method and apparatus for preventing plugging of an oil well pump in a well which produces fluids containing suspended particles.

BACKGROUND OF THE INVENTION

Oil wells which penetrate formations that produce heavy crude oils often produce fluids laden with sand. A recurring problem in the production of well fluids from such wells is the plugging, jamming or seizing of bottom hole pumps. Most wells exhibit a threshold rate at which formation fines become mobile in the formation and are produced because of drawdown and velocity of the fluids being produced. The threshold rate in unconsolidated sand formations is very low. The problem is acute when heavy oil is produced because it is usually found in shallow, unconsolidated sand formations and the sand is often too fine to screen out without plugging the screen or limiting throughput to an unacceptable degree. For example, heavy viscous crudes which are relatively close to the earth's surface contain sand and are difficult to pump. Steam and diluents have often been used to lower the viscosity of such heavy crudes to improve flow and pumping efficiency. However, sand is still a major problem.

Most of the oil fields in Canada have been exploited for a long period of time and are relatively old, so they now produce over 90% water. In the United States, most of the on-shore fields are in an even more advanced state of decline. The wells that are currently being drilled in Canada and the United States enter a state of decline in a much shorter time than the wells which were drilled in the past. On average, a well drilled today has a service life of about five years from the first production to abandonment. Wells which produce high percentages of water must be produced at a high rate to yield enough oil to be economic. Thus, most wells are now being produced over the threshold rate discussed above and sand is produced with the water/crude mixture.

Another source of sand production in wells is fracture propant which is injected into a producing formation during a process well known in the industry as hydraulic fracturing, which is used to increase the productivity of wells.

People in the industry have made efforts to overcome this long-standing problem. Different types of pumps and special pumping systems have been suggested for improving the productivity of well fluids containing suspended particles. Progressing cavity pumps (PCP) are the most successful type of pump in common use in wells today for pumping sand laden crude oil because the PCP is an excellent sludge pump. However, when a PCP is stopped during production of sand-laden crude, sand suspended in the production tubing settles out of suspension and may plug the production tubing. It takes less than a metre of sand to form a plug which cannot be breached with the pressure available from the pump. Furthermore, the pump is usually driven backwards when it is stopped because of the draining of the well fluids in the production tubing string through the pump. If this happens, the sand plug may extend into the pump and seize it.

The problems described above are not unique to PCPs and are actually more severe with other types of pumps. For example, sand plugging problems occur to pumping systems using dual tubing strings which have been suggested to be used for pumping heavy viscous and sand laden oil. An improved parallel tubing system for pumping well fluids is described in U.S. Pat. No. 5,505,258, entitled PARALLEL TUBING SYSTEM FOR PUMPING WELL FLUIDS which issued to Muth on Apr. 9, 1996. Muth teaches a production tubing between the earth's surface and a production zone in the well for receiving well production fluids from a pump located in a power tubing. A flow control valve is located in the lower end of the production tubing to permit the flow of the production fluids up to the earth's surface and prevent the flow of production fluids down through the production tubing. The flow control valve is located in close proximity to the pump. The power tubing extends down the well in a parallel relationship with the production tubing to the production zone in the well. Production fluids pumped by the pump are down into a lower portion of the power tubing. The pump is located in the lower portion of the power tubing and driven by a pump rod string that extends down through the power tubing. A cross-over flow path is formed between the low portion of the power tubing and the production tubing below the flow control valve for flowing production fluids out of the power tubing and into the production tubing, the production fluids then being transferred to the earth's surface through the production tubing.

Although the system described by Muth has many advantages and does prevent sand from plugging the pump if there is an interruption in the operation of the pump, it does not provide a solution for restarting production after sand has settled out above the valve. As pointed out by Muth, a pump is sanded up or stuck in the pipe because of sand settling out of the production fluids on top of the pump whenever the well is idle for short periods of time. When this happens, an unprotected pump has to be retrieved from the well if the production is to be resumed. In a conventional system, the tubing string and sucker rods usually are pulled "wet", because the clogged tubing cannot be drained, which is not only an awkward operation, it can also cause objectionable oil spills on the surface. With the system described by Muth, however, the wet operation can be avoided regardless of how much sand the well is production because a sand plug in the production tubing can be cleaned out with coil tubing or bailing or other methods known in the art. Nevertheless, such cleanout takes time and is not without expense.

Consequently, it is desirable to have an apparatus that will prevent particles that settle out of well fluids from clogging a pump when the pump is idled for a short period of time. It is also desirable, if the apparatus permits, particles to be resuspended after they settle out of well fluids and plug the production tubing so that the resuspended particles can be pumped up out of the production tubing and production can be easily resumed after the production is idled.

SUMMARY OF THE INVENTION

An object of the invention is to provide an apparatus for preventing plugging of an oil well pump in a well which produces fluids containing suspended particles.

Another object of the invention is to provide a method of resuspending particles that settle out of well fluids in a production tubing of a well during an idle period of the pump, to permit production from the well to be restarted.

A further object is to provide a simple and economical solution for preventing clogging of an oil well pump in a well which produces fluids containing suspended particles, and resuspending the particles that settled out from well fluids in a production tubing during a period that the pump was in idle.

In accordance with one aspect of the invention a method of preventing plugging of an oil well pump in an well which produces fluids containing suspended particles comprises setting a valve in a production tubing above the pump, the valve permitting well fluids to flow up past the valve while inhibiting the well fluids from flowing back past the valve, the valve being positioned to trap a volume of the well fluids between a bottom of the valve and a top of the pump adequate to permit a pressure wave to be developed between the pump and the valve when the pump is restarted from an idle condition; and after a period during which the pump was idle and the particles settled from the well fluids above the valve, starting and stopping the pump causes the pressure wave in the well fluids to force the well fluids past the valve until the particles that have settled are resuspended to an extent adequate to permit production through the production tubing to resume.

An apparatus for application of the method preferably includes a valve insertable into and removable from a production tubing above the pump so that the trapped volume of well fluids between the bottom of the valve and the top of the pump is adequate to permit a pressure wave induced by a starting of the pump to develop. Preferably, the valve is positioned about 20–40 meters (60–125') above the pump. To ensure uninhibited operation of the valve, all linkages between the pump and ground equipment are preferably routed outside of the production tubing.

The advantage of the invention lies in a simple, low cost solution to a long standing problem which previously required pulling of the production tubing from the well in a "wet" condition in order to remove particles so that production could be restarted, or in the case of the rodless systems, inserting a coiled tubing or a bailing tool to clear sand trapped above the standing valve.

DETAILED DESCRIPTION OF THE PREFERRED EMBODIMENT

Figures 1, 1A:
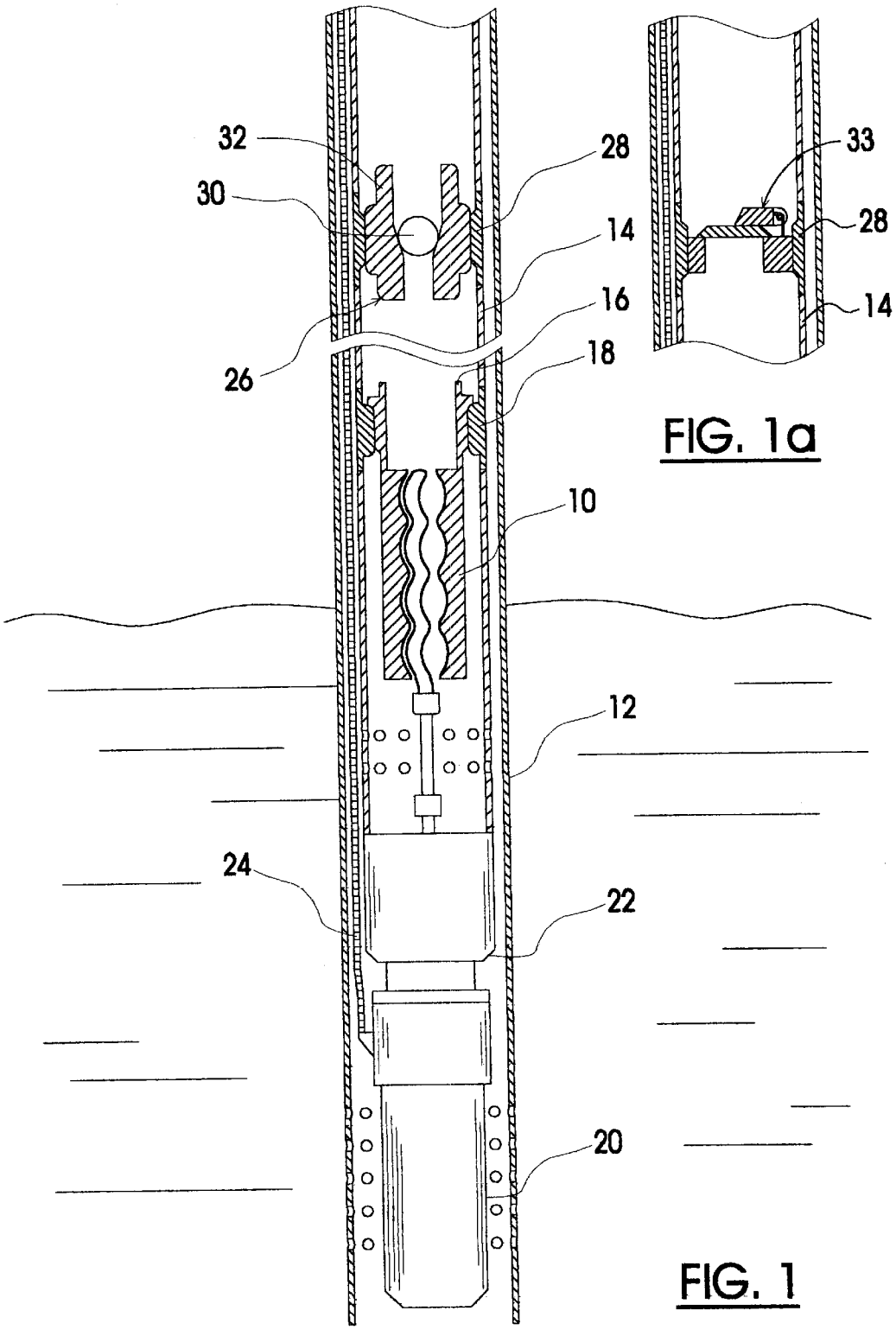
FIG. 1 is a diagrammatic sectional view of an oil well pumping system in which an apparatus is used in accordance with the invention.
FIG. 1*a* is a diagrammatic sectional view of a flapper valve for use in the oil well pumping system shown in FIG. 1.

FIG. 1 illustrates a submersible progressing cavity pump (PCP) 10 of a type commonly used for pumping sand laden crude oil from a well casing 12 into a production tubing 14. The PCP 10 is inserted into a production zone of the well, and secured via a pump seating mandrel 16 and pump seating nipple 18 to a lower end of the production tubing 14. The PCP 10 is driven by a submersible electric motor through a speed reducer 22. The assembly of the submersible electric motor 20 and the speed reducer 22 is also attached to the lower end of the production tubing 14, and operably connected to the PCP 10. An electrical cable 24 for powering the submersible electric motor 20 extends through the casing 12 of the well outside the production tubing 14 so that there are no obstructions within the production tubing 14.

Particles suspended in the well fluids produced through the production tubing 14 are pumped to the surface as long as the PCP is operative. However, if the pump becomes idle for even a short period of time due to a power interruption, or the like, suspended particles will settle out of the well fluids on top of the PCP 10 and clog the production tubing 14. In fact, the particles may infiltrate the PCP 10 and seize it if the PCP 10 is driven backwards by the draining, through the PCP 10 of well fluids in the production tubing. To prevent clogging of the PCP 10, a standing valve 26 is positioned above the PCP 10 in the production tubing 14. The standing valve 26 is detachably secured to the production tubing 14 using a pump seating nipple 28, or the like. The standing valve 26 may be installed and retrieved using wire lines or sucker rods, which are well known in the industry. The standing valve 26 is preferably a simple ball and seat check valve, although other types of valves, such as a flapper valve 33 (see FIG. 1*a*) or the like, may likewise be used. The standing valve 26 includes a ball 30 and a seat 32, permitting well fluids to flow up past the valve 26 while inhibiting the well fluids from flowing back past the valve so that the particles that settled out of the well fluids in the production tubing when the PCP 10 is idle, are trapped above the standing valve 26, and do not plug the PCP 10.

FIGS. 2*a*–2*d* illustrate a method in accordance with the invention of resuspending particles that settle out of the well fluids when the PCP 10 is idle. In a normal operation of a pump, pressure generated by the pump on startup is not adequate to breach a sand plug that has formed in the production tubing when particles settle out of the well fluids during an idle period of the pump. In general, liquids such as crude oil or crude/water blends are not compressible and a small volume of trapped liquid within the pump does not permit a pressure wave to be developed that is adequate to break up the plug. Practically all crude oils contain at least some natural gas. As particles suspended in the well fluids settle out of the fluids when the pump stops, there is a tendency for the natural gas contained in the well fluids to separate out. Natural gas is compressible. Therefore, if adequate space is provided between a top of the pump and a bottom of the standing valve, the volume of well fluids trapped between the standing valve 26 and the PCP 10 is large enough to permit pressure waves to be developed when the PCP 10 is started. The development of the pressure wave can be aided by a compressible gas layer collected under the standing valve.

Figure 2D:
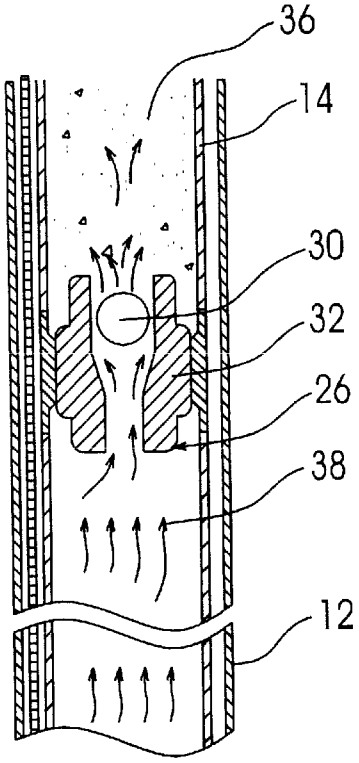
FIGS. 2*a*–2*d* is a series of cross-sectional views of the apparatus in operation, showing the principle of the method in accordance with the invention.
Figure 2C:
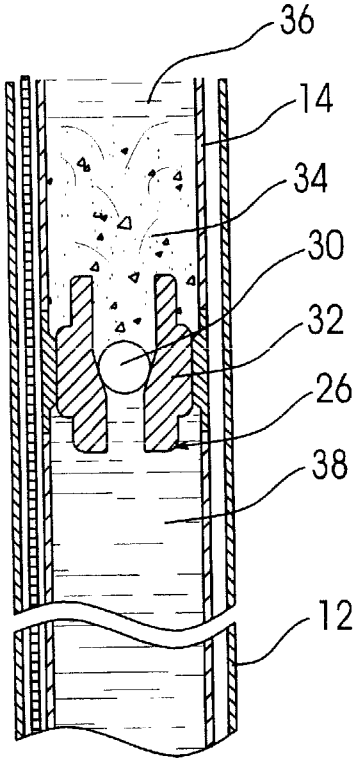
Figure 2B:
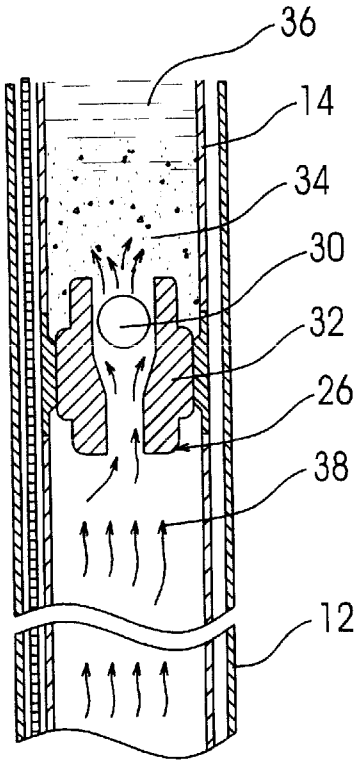
Figure 2A:
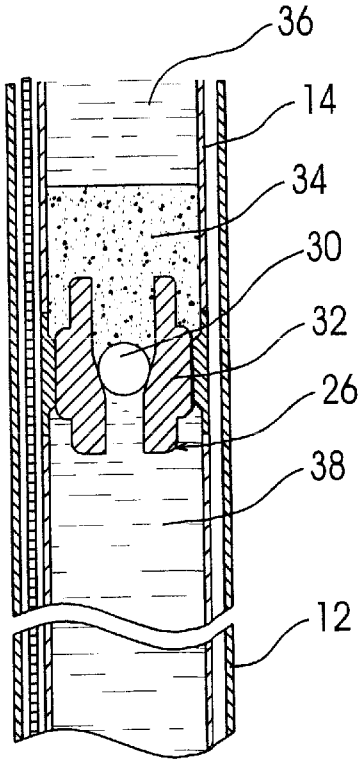

FIGS. 2*a*–2*d* illustrate the method of resuspending particles that have settled out of well fluids trapped above the standing valve 26 while the PCP 10 was idle. In FIG. 2*a*, the production tubing 14 above the standing valve 26 is clogged with particles 34 that settled out of the well fluids 36 contained in the production tubing 14 above the standing valve 26. The standing valve 26 is mounted far enough above the PCP 10 (FIG. 1) to permit a pressure wave to be developed between the PCP 10 and the standing valve 26, while being near enough (20–50 m.) to prevent a large volume of sand from precipitating onto the pump. If the pump is started after an idle period and run for a short interval, a pressure wave is developed in the trapped well fluids 38 that delivers pressure generated by the pump to the standing valve 26. Normally, a single pressure wave is not adequate to lift the valve 26 far enough to breach the plug formed by the particles 34. However, if the pump is started and stopped repeatedly, the trapped well fluids 38 behave as a resilient body in which pressure waves induced by the repeated starting and stopping action of the PCP 10 agitate the ball of the standing valve to resuspend the particles 34.

As the pressure wave in the trapped well fluids 38 develops, the peak pressure gradually increases until the ball 30 is lifted from the seat 32 and well fluids 38 are forced past the valve 26 to mix with the settled particles trapped above the valve 26, as shown in FIG. 2*b*. As a result, part of particles 34 become resuspended in the well fluids 36. The valve 26 remains open only for a relatively short period of time before the ball returns to the closed position. After the peak pressure subsides, however, at least part of the particles remain in suspension as shown in FIG. 2*c*. Consequently, by repeatedly starting and stopping the pump, subsequent pressure waves force more well fluids 38 past the valve 26 until most of the particles 34 are resuspended, as illustrated in FIG. 2*d*. The settled particles plugging the production tubing 14 are thus removed and the production from the well is resumed without the time and expense of running in coiled tubing or a bailing tool to remove the particles.

Although there is no firm rule about how long the pump should be run to create the pressure waves, a practical solution is to place an amperage meter between the switch and the pump in order to assess current draw. In general, the pump should be run until the meter indicates that the current draw approaches a maximum current rating of the motor. The pump is then turned off for a short period of time to permit the pressure to subside before the pump is restarted to create a next pressure wave.

In order to ensure good results, it is important to position the standing valve 26 far enough above the pump to trap a volume of well fluids 38 which is adequate to permit pressure waves to be developed when the pump is started. However, as noted above, the well fluid 38 trapped between the bottom of the standing valve 26 and the top of the pump also contains suspended particles that will settle out of the well fluids 38 onto the pump. The larger volume of well fluids trapped between the pump and the valve, the greater the volume that will settle out of the well fluids onto the pump. If the volume of particles 34 accumulated on the pump forms a plug that the pump is not able to breach, starting and stopping the pump will not be effective because pressure waves cannot be developed in the trapped well fluids 38. Therefore, the standing valve 26 should be positioned about 20 to 50 metres (60' to 150') above the pump, preferably about 30 metres (about 90'), i.e. about three tubing joints above the pump. The preferred range depends on various properties of the well fluids, particularly, the proportion and type of suspended particles, the viscosity of the crude and the proportion of gas in the fluids produced.

As a general rule, if the proportion of suspended particles is relatively low, the standing valve 26 can be positioned further from the pump. As the viscosity of the crude oil increases, the distance between the pump and the standing valve should be decreased. With respect to the proportion of gas in the fluids produced, the greater the volume of gas, the less distance required between the pump and the standing valve.

The method described above works well if the particles are permeable and, therefore, readily resuspended. This is the case if the particles are fracturing proppants. The success rate is less if the settled particles are impermeable formation fines. However, if the settled particles cannot be resuspended by the pump, they may be removed using coiled tubing, bailing or similar techniques that are well known in the industry. Even if such intervention is required, the pump can be restarted because it was not seized by the particles.

Figure 3:
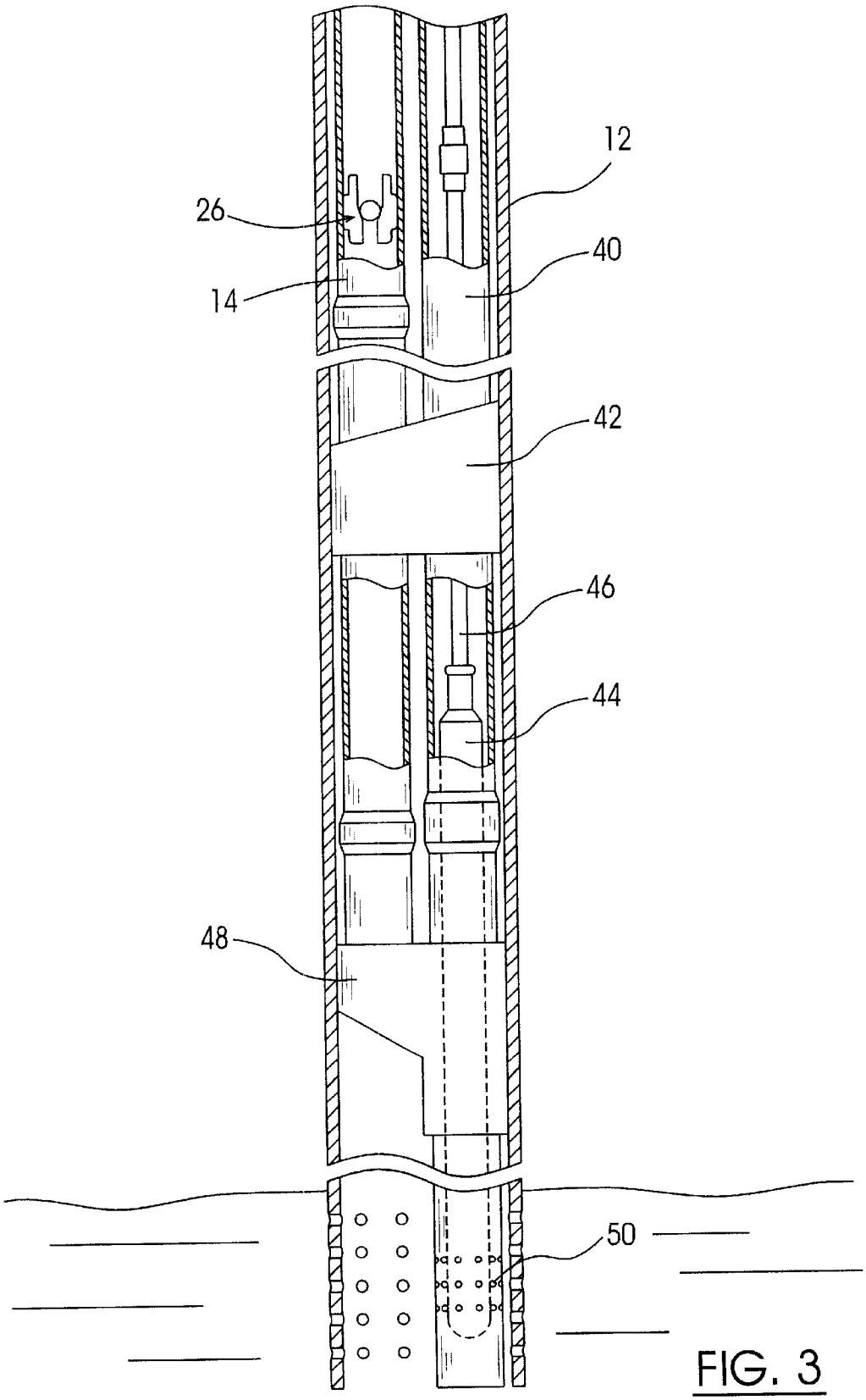
FIG. 3 is a diagrammatic sectional view of a dual string pumping system in which the apparatus in accordance with the invention is used.

The invention is also applicable to other types of pumps if the production tubing is unobstructed to permit uninhibited operation of the standing valve. The invention may therefore be applied to sucker rod driven pumps, if a dual tubing system such as described by Muth in U.S. Pat. No. 5,505,258 is used to isolate the sucker rod string from the production tubing, as illustrated in FIG. 3. The dual tubing system includes a production tubing 14 and a power tubing 40 that extends down the well casing 12 in a parallel relationship. A parallel anchor. 42 is inserted into the well casing 12. The parallel anchor 42 has a first passage on the left and a second passage on the right of the anchor, not shown, to accommodate and stabilize the respective production tubing 14 and power tubing 40. A downhole rod insert pump 44 or a PCP pump 10 (FIG. 1) is positioned in a lower end portion of the power tubing 40 and is driven by a sucker rod string 46 which is housed by the power tubing 40. A cross-over flow head 48 interconnects the bottom end of the production tubing 14 and the lower end portion of the power tubing 40 to form a cross-over fluid path (not shown) between the production tubing 14 and the power tubing 40. When the pump 44 is driven by the sucker rod string 46, the well fluids are drawn through apertures 50 in the lower end of the power tubing 40 and pumped out via apertures (not shown) into the cross-over flow path within the cross-over flow head 48, from which the fluids are directed into a bottom end of the production tubing 14. The standing valve 26 is inserted into the production tubing 14 and anchored about 20–50 meters (60'–150') above the pump 44. The standing valve 26 performs the exact same function as described above with respect to the embodiment shown in FIG. 1, permitting the well fluids produced by the pump 44 to flow up through the production tubing 14 past the valve 26 while inhibiting the well fluids in the production tubing 14 from flowing back past the valve 26. The particles suspended in the well fluids settle out of the well fluids and are trapped by the valve 26, so they do not plug the pump 44 when the pump 44 is idled. In order to resuspend those particles and to resume the production, the method described with reference to FIGS. 2*a*–2*d* is used.

Changes and modifications to the embodiments of the invention described above will no doubt become apparent to those skilled in the art in view of the foregoing disclosure. For example, although the invention has been described with reference exclusively to vertical well bores, the methods and apparatus described are equally applicable to horizontal bores. The scope of the invention is therefore intended to be limited solely by the scope of the appended claims.

I claim:

1. A method of preventing plugging of an oil well pump in a well which produces fluids containing suspended particles, comprising:

setting a valve in a production tubing above the pump, the valve permitting well fluids to flow up past the valve while inhibiting the well fluids from flowing back past the valve, the valve being positioned to trap a volume of the well fluids between a bottom of the valve and a top of the pump adequate to permit pressure waves to be generated between the pump and the valve when the pump is restarted from an idle condition; and after a period during which the pump was idle and the particles settled from the well fluids above the valve, starting and stopping the pump to generate the pressure waves in the well fluids in order to force the well fluids past the valve until the particles that have settled are resuspended to an extent adequate to permit production through the production tubing to resume.

2. A method as claimed in claim 1 further comprising a step of monitoring a current draw of a motor that drives the pump when the pump is started to generate a pressure wave.

3. A method as claimed in claim 2 wherein the current draw of the motor is monitored by placing an amperage meter between the pump and a switch to control current flow to the motor.

4. A method as claimed in claim 3 wherein the motor is operated after it is started to generate the pressure wave until a current draw of the motor approaches a maximum current rating of the motor.

5. A method as claimed in claim 1 wherein the valve is positioned in the production tubing about 20 to 50 meters (60' to 150') above the oil well pump.

6. A method as claimed in claim 5 wherein the valve is positioned in the production tubing three production tubing joints above the oil well pump.

7. An apparatus for preventing plugging of an oil well pump in a well which produces fluids containing suspended particles, comprising a valve placed in a production tubing of the well, the valve permitting well fluids to flow up past the valve while inhibiting the well fluids from flowing back past the valve, the valve being positioned above the pump to trap a volume of the well fluids between a bottom of the valve and a top of the pump adequate to permit pressure waves which are generated by starting the pump to be developed to force the well fluids past the valve until the particles that have settled during a period in which the pump was idle are resuspended to an extent adequate to permit production through the production tubing to resume.

8. An apparatus as claimed in claim 7 wherein the valve is insertable into and removable from the production tubing while the production tubing is positioned in the well.

9. An apparatus as claimed in claim 7 wherein the valve is a ball and seat check valve.

10. An apparatus as claimed in claim 7 wherein the valve is a flapper valve.

11. An apparatus as claimed in claim 7 wherein the valve is positioned in the production tubing about 20 to 50 meters (60' to 150') above the pump.

12. An apparatus as claimed in claim 10 wherein the valve is positioned in the production tubing at least three production tubing joints above the pump.

13. An apparatus as claimed in claim 7 wherein all linkages between the pump and ground equipment are routed outside of the production tubing.

14. An apparatus as claimed in claim 7 wherein the pump is driven by a submersible electric motor and speed reducer, the motor and speed reducer being attached to the production tubing below the pump, and an electric cable for powering the motor extends through a casing of the well outside the production tubing.

15. An apparatus as claimed in claim 7 further comprising:

a power tubing containing the oil well pump in a lower end thereof, the power tubing extending down the well in a parallel relationship with the production tubing to a production zone in the well; and a cross-over flow device interconnecting the production tubing and the power tubing for directing the well fluids produced by the pump into the production tubing.

16. An apparatus as claimed in claim 15 wherein the pump is a reciprocating insert pump driven by a sucker rod string that extends through the power tubing.

17. An apparatus as claimed in claim 15 wherein the pump is a progressive cavity pump driven by a sucker rod string that extends through the power tubing.

* * * * *

UNITED STATES PATENT AND TRADEMARK OFFICE

CERTIFICATE OF CORRECTION

PATENT NO. : 6,371,206 B1
DATED : April 16, 2002
INVENTOR(S) : Ray G. Mills

It is certified that error appears in the above-identified patent and that said Letters Patent is hereby corrected as shown below:

Title page,
Item, [75], please change "Ray J. Mills" to -- Ray G. Mills --.

Signed and Sealed this

Eighteenth Day of February, 2003

JAMES E. ROGAN
*Director of the United States Patent and Trademark Office*